US006409015B1

(12) United States Patent
Hu

(10) Patent No.: US 6,409,015 B1
(45) Date of Patent: Jun. 25, 2002

(54) TOOL PACK WITH A FLEXIBLE PORTION AND A TRY-ON DEVICE

(76) Inventor: Bobby Hu, 8th Floor, Suite 1, No. 536, Da-Jinn Street, Nan Twen, Taichung (TW)

( * ) Notice: Subject to any disclaimer, the term of this patent is extended or adjusted under 35 U.S.C. 154(b) by 0 days.

(21) Appl. No.: 09/765,354

(22) Filed: Jan. 22, 2001

(30) Foreign Application Priority Data

Sep. 7, 2000 (TW) ..... 89215602 U

(51) Int. Cl.[7] ..... B65D 73/00
(52) U.S. Cl. ..... 206/378; 349/372; 349/493
(58) Field of Search ..... 206/349, 372–378, 206/461, 470, 476–483, 486–488, 806, 493

(56) References Cited

U.S. PATENT DOCUMENTS 4,019,632 A * 4/1977 Greenlee ..... 206/349
4,450,961 A * 5/1984 Bies et al. ..... 206/349
5,477,964 A * 12/1995 Hart ..... 206/349
5,785,174 A * 7/1998 Chow ..... 206/349
5,988,381 A * 11/1999 Ling ..... 206/349

* cited by examiner

*Primary Examiner*—Jim Foster
(74) *Attorney, Agent, or Firm*—Rosenberg, Klein & Lee

(57) ABSTRACT

A tool pack comprises a board including an annular toothed portion and a rotary member. An end face of an end of the rotary member has an annular toothed portion. The end of the rotary member is engaged with the board to allow rotation of the rotary member relative to the board with the annular toothed portion of the rotary member meshing with the annular toothed portion of the board. A second end of the rotary member may be engaged with an end of a tool to rotate therewith. When the rotary member is turned, the annular toothed portion of the rotary member moves across the annular toothed portion of the board to generate clicks.

17 Claims, 15 Drawing Sheets

TOOL PACK WITH A FLEXIBLE PORTION AND A TRY-ON DEVICE

BACKGROUND OF THE INVENTION

1. Field of the Invention

The present invention relates to a tool pack that has a flexible portion for packing a hand tool at a lower profile. The present invention also relates to a tool pack that has a try-on device to allow customers to try the hand tool.

2. Description of the Related Art

U.S. Pat. No. 5,785,174 to Chow issued on Jul. 28, 1998 discloses a display pack having a rotatable security member that allows customers to try the hand tool packed in the tool pack. The display pack includes a board with a hole having a toothed inner periphery. The rotatable security member includes a polygonal head and a shank which has a toothed periphery rotatably engaged in the hole of the board. A customer may engage a ratchet tool with the polygonal head and rotate it to achieve the try-on purpose. Clicks are generated when the toothed outer periphery of the shank move across the toothed inner periphery of the hole of the board to attract the customer. However, the toothed outer periphery of the shank and the toothed inner periphery of the hole of the board tend to wear out due to friction and thus fail to provide the required function of generating clicks. In addition, the display pack is not suitable to pack a combination wrench that includes an end at an angle with the other end, as the profile of the tool pack after packing is relatively high and thus takes up a considerable space and is this inconvenient to transport. All existing tool packs are also suffered from this drawback.

SUMMARY OF THE INVENTION

In accordance with a first aspect of the invention, a tool pack comprises:

a board including a hole, the board further including an annular toothed portion surrounding the hole;

a sounding plate including a positioning hole, the sounding plate further including an annular toothed portion on a side thereof and surrounding the positioning hole; and a rotary member having a first end and a second end, the first end of the rotary member being extended through the positioning hole of the sounding plate and the hole of the board to allow simultaneous rotation of the rotary member and the sounding plate relative to the board with the annular toothed portion of the sounding plate meshing with the annular toothed portion of the board, the second end of the rotary member being adapted to be engaged with an end of a tool to rotate therewith;

wherein the sounding plate is turned when the rotary member is turned, and the annular toothed portion of the sounding plate moves across the annular toothed portion of the board to generate clicks.

The board includes a non-rectilinear slot to thereby define a flexible portion including the annular toothed portion of the board, whereby the annular toothed portion of the board is moved slightly away from the annular toothed portion of the sounding plate during rotation of the sounding plate to reduce wear to the annular toothed portion of the board and the annular toothed portion of the sounding plate. In addition, the flexible portion may reduce a profile of a tool packed by the tool pack by means of bending the flexible portion relative to a remaining portion of the board.

The annular toothed portion of the board and the annular toothed portion of the sounding plate consist of a plurality of planar teeth. In an embodiment of the invention, the annular toothed portion of the board is formed on a front side of the board and the sounding plate is mounted to the front side of the board. In another embodiment of the invention, the annular toothed portion of the board is formed on a rear side of the board and the sounding plate is mounted to the rear side of the board. The rotary member comprises a resilient hook with a longitudinal slit. The resilient hook is compressed when passing through the hole of the board and the positioning hole of the sounding plate and then returned to its initial position to thereby provide a positioning effect.

The board may further include a frame for limiting rotation of the tool. The board includes an engaging hole and the frame comprises a first end pivotally connected to the board and a second end releasably engaged with the engaging hole of the board.

In accordance with a second aspect of the invention, a tool pack comprises:

a board including an annular toothed portion; and a rotary member having a first end and a second end, the first end of the rotary member including an end face with an annular toothed portion, the first end of the rotary member being engaged with the board to allow rotation of the rotary member relative to the board with the annular toothed portion of the rotary member meshing with the annular toothed portion of the board, the second end of the rotary member being adapted to be engaged with an end of a tool to rotate therewith;

wherein when the rotary member is turned, the annular toothed portion of the rotary member moves across the annular toothed portion of the board to generate clicks.

The annular toothed portion of the board and the annular toothed portion of the rotary member consist of a plurality of planar teeth. In an embodiment of the invention, the board includes a hole and the annular toothed portion of the board surrounds the hole, and the first end of the rotary member is rotatably engaged in the hole of the board. In another embodiment of the invention, the board includes a peg and the annular toothed portion of the board surrounds the peg, and the first end of the rotary member is rotatably engaged in the peg of the board.

The present invention also provides a tool pack comprising a board having a non-rectilinear slot defined therein to thereby form a flexible portion. The flexible portion is flexible relative to a remaining portion of the board and engageable with an angled tool that includes a first end and a second end at an angle with the first end. One of the first end and the second end of the angled tool is engaged with the flexible portion and a profile of the angled tool can be reduced by means of bending the flexible portion such that the angled tool can be packed at a reduced profile.

Other objects, advantages, and novel features of the invention will become more apparent from the following detailed description when taken in conjunction with the accompanying drawings.

BRIEF DESCRIPTION OF THE DRAWINGS

FIG. 4 is a top view of the tool pack and a combination wrench for try-on.

DETAILED DESCRIPTION OF THE PREFERRED EMBODIMENTS

Figure 1:
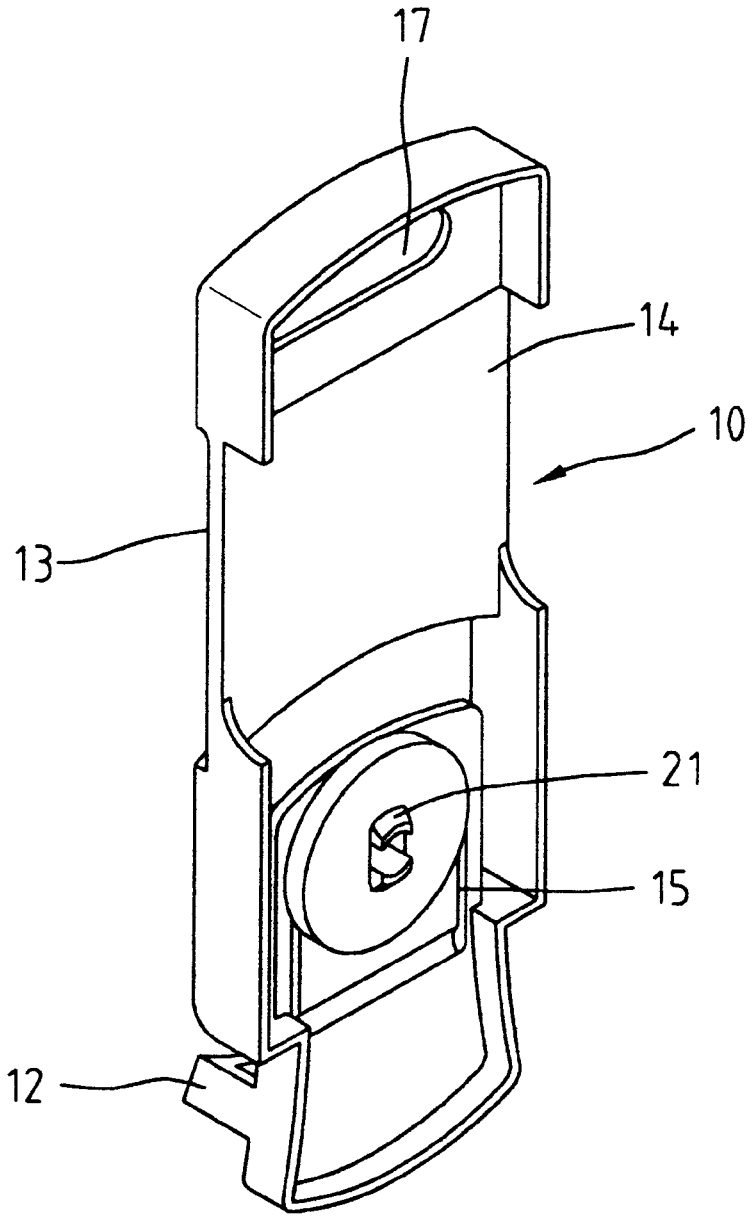
FIG. 1 is a rear perspective view of a first embodiment of a tool pack in accordance with the present invention.
Figure 2:
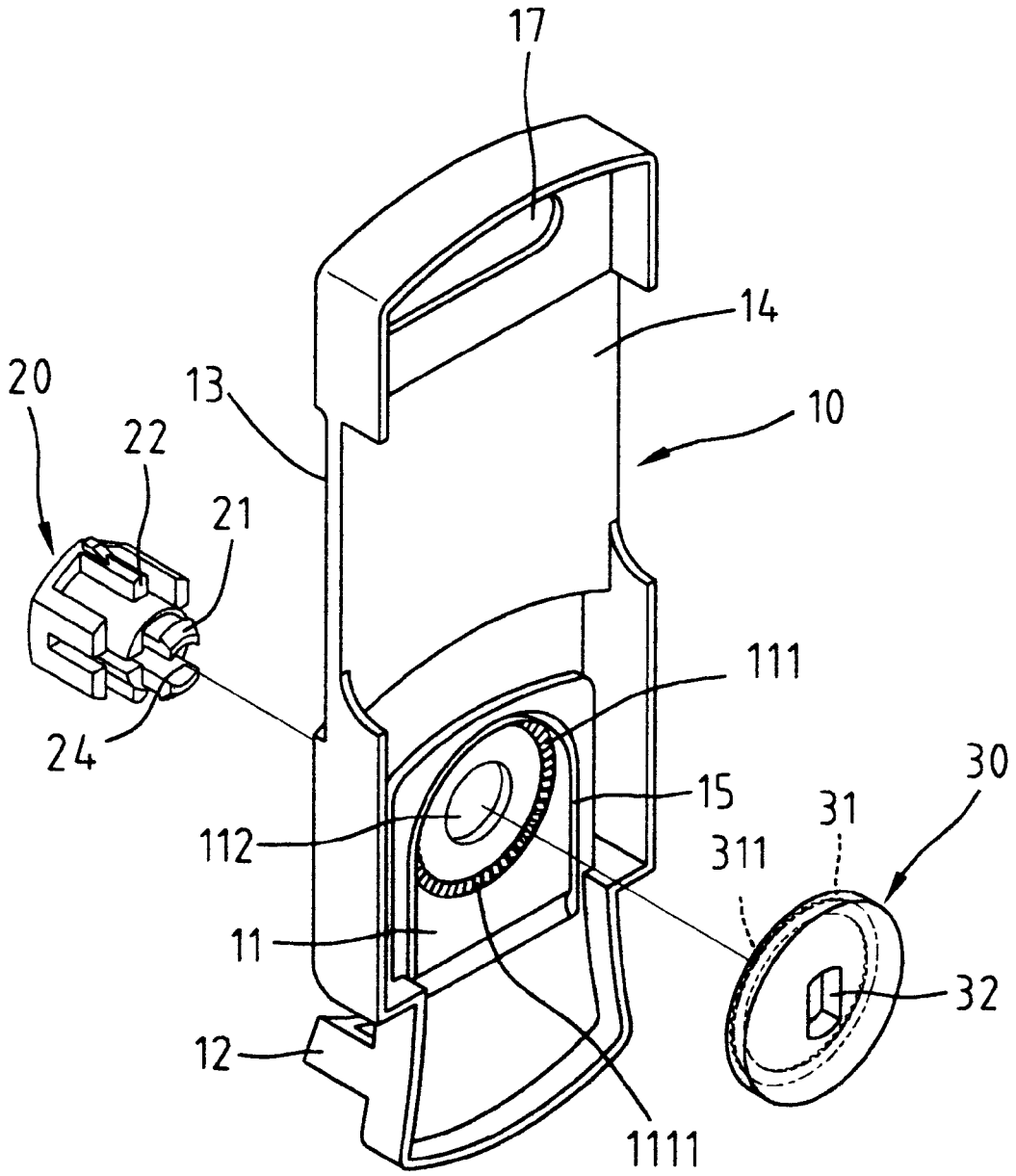
FIG. 2 is an exploded rear perspective view of the first embodiment of the tool pack in accordance the present invention.
Figure 3:
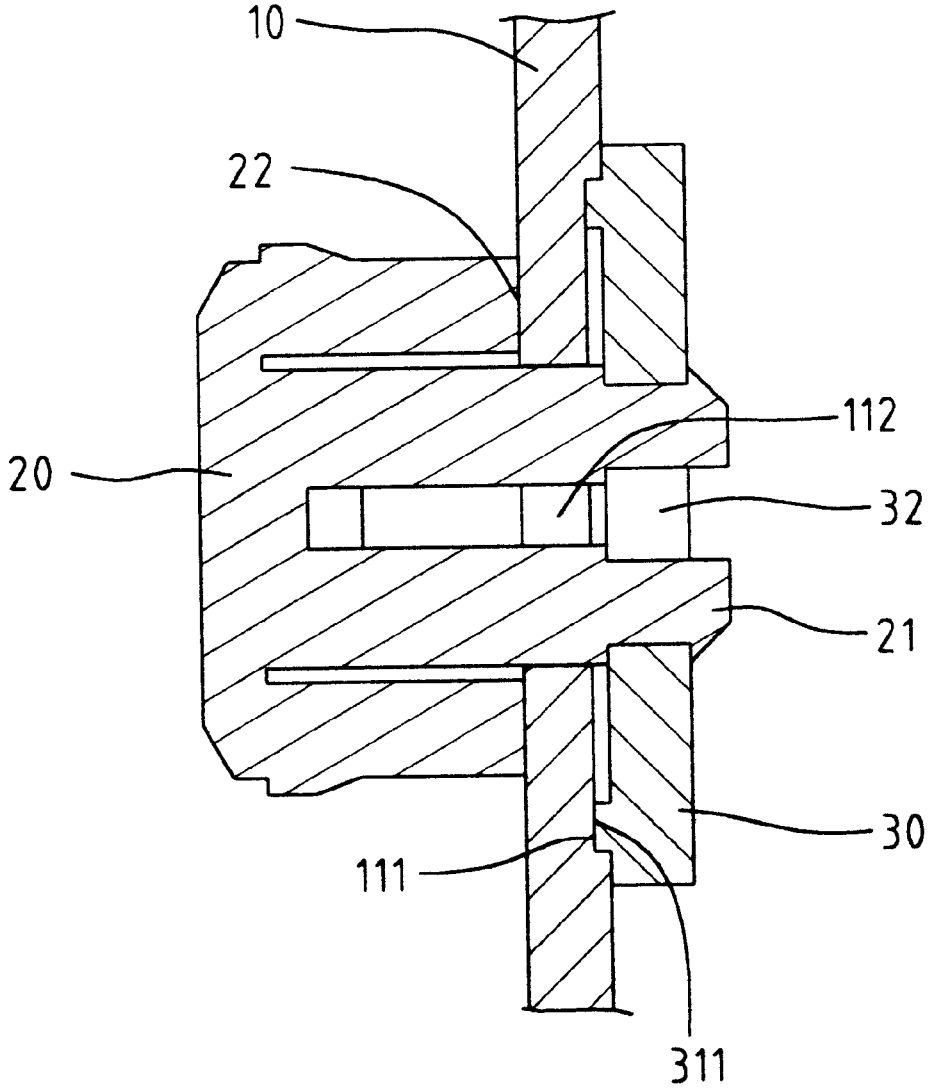
FIG. 3 is an enlarged partial sectional view of the tool pack in FIG. 1.

Referring to FIGS. 1 through 3, a first embodiment of a tool pack in accordance with the present invention generally includes a board 10 having a front side 13 and a rear side 14. A hanging hole 17 is defined in an upper end of the board 10 and a frame, 12 is integrally formed on a lower end of the board 10. A non-rectilinear (e.g., U-shape) slot 15 is defined in the board 10, thereby forming a flexible portion 11 that is flexible relative to the remaining portion of the board 10. The flexible portion 11 has a hole 112 that extends from the first side 13 through the second side 14 of the board 10 and an annular toothed portion 111 is formed on the rear side 14 of the board 10 and surrounds the hole 112. The annular toothed portion 111 consists of a plurality of planar teeth 1111.

A rotary member 20 that is substantially hexagonal includes a plurality of annularly spaced abutting elements 22 extending outward along a longitudinal direction of the rotary member 20. A resilient hook 21 extends longitudinally from a side of the rotary member 20 in a space defined by the abutting elements 22. The resilient hook 21 has a longitudinal slit 24 in a distal end thereof A sounding plate 30 in the form of a disc is mounted to the rear side 14 of the board 10. The sounding plate 30 includes a positioning hole 32 and an annular toothed portion 31 consisting of a plurality of planar teeth 311. Preferably, the annular toothed portion 31 surrounds the positioning hole 32 that is preferably located in a center of the sounding plate 30.

In assembly, as illustrated in FIGS. 2 and 3, the resilient hook 21 of the rotary member 20 is extended through the hole 112 of the board 10 and the positioning hole 32 of the sounding plate 30. Referring to FIG. 3, the resilient hook 21 is compressed when it is passing through the hole 112 of the board 10 and the positioning hole 32 of the sounding plate 30 and then expands outward to its initial position and is thus engaged with the sounding plate 30. The annular toothed portion 31 of the sounding plate 30 is meshed with the annular toothed portion 111 of the flexible portion 11 of the board 10. It is noted that the abutting elements 22 abut against the front side 13 of the board 10, best shown in FIG. 3.

Figure 4:
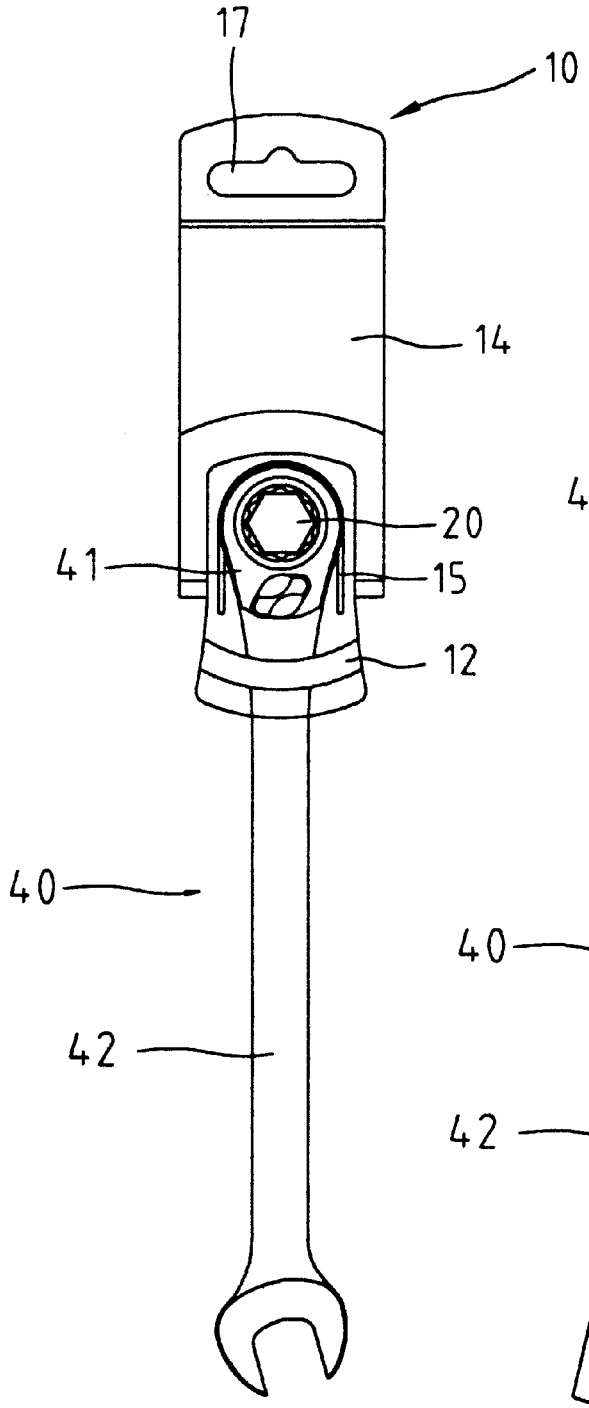
Figure 5:
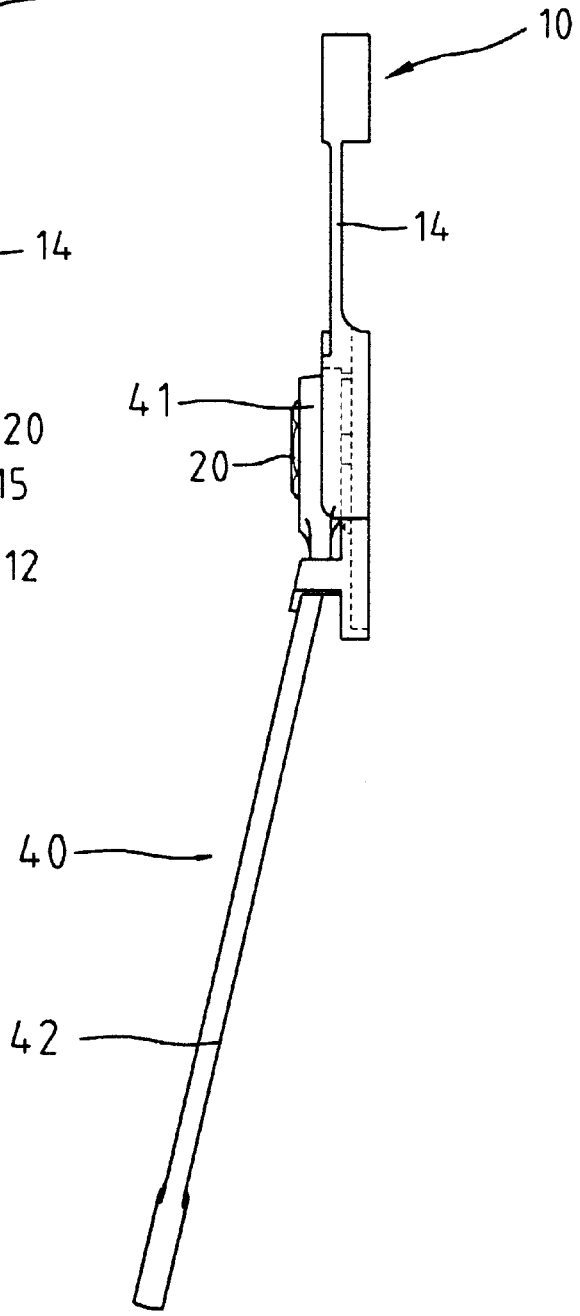
FIG. 5 is a side view of the tool pack and the combination wrench in FIG. 4.

In use, as illustrated in FIGS. 4 and 5, a customer may extend an end (e.g., the box end 41) of a hand tool (e.g., a combination wrench 40) through the frame 12 and engage the end 41 with the rotary member 20. Then, the customer may try the combination wrench 40 by turning it. Two sides of the frame 12 limit rotation of the combination wrench 40. The sounding plate 30 is rotated when the combination wrench 40 is turned. Thus, the annular toothed portion 31 of the sounding plate 30 turns relative to the annular toothed portion 111 of the flexible portion 11 of the board 10 and generate "clicks". It is noted that due to provision of the flexible portion 11, the annular toothed portion 111 of the flexible portion 11 of the board 10 is moved slightly away from the annular toothed portion 31 of the sounding plate 30 during rotation of the sounding plate 30. This avoids abrasion and wear to the annular toothed portion 31 of the sounding plate 30 and the annular toothed portion 111 of the flexible portion 11 of the board 10, and the clicks thus generated are loud.

Figure 6:
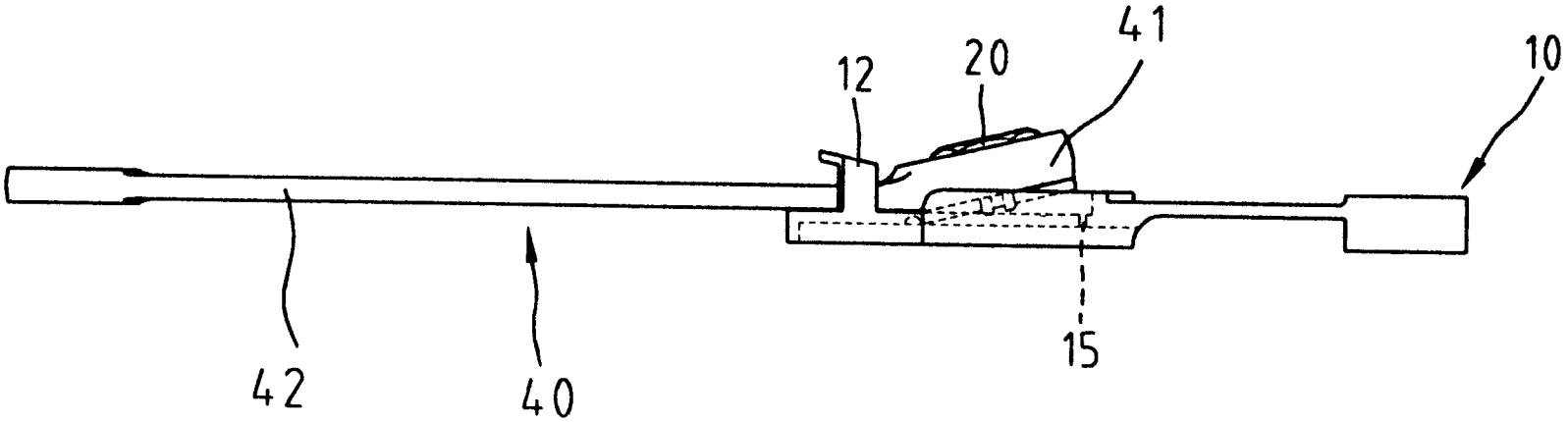
FIG. 6 is a side view similar to FIG. 5, wherein the combination wrench is bent to lower its profile for packing.

Referring to FIG. 6, a further advantage provided by the flexible portion 11 of the board 10 is that, when packing a hand tool, such as a combination wrench 40 that has an end 41 at an angle with the other end 42, the other end 42 of the combination wrench 40 may be pushed toward the board 10 and thus has a lower profile for packing. The flexible portion 11 of the board 10 allows such packing by means of bending of the flexible portion 11 relative to the remaining portion of the board 10. This is extremely advantageous to transport, as the overall volume for the tool pack is reduced.

Figure 7:
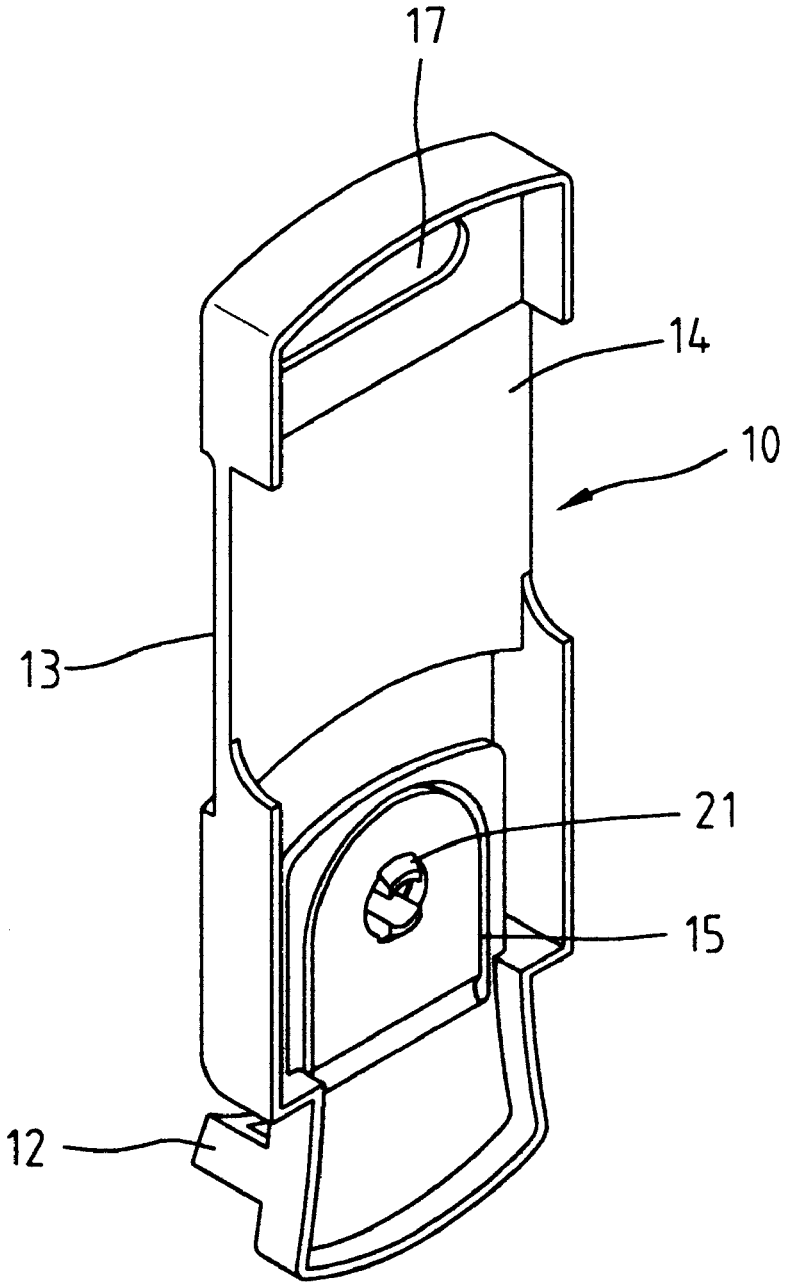
FIG. 7 is a rear perspective view of a second embodiment of the tool pack in accordance with the present invention.
Figure 8:
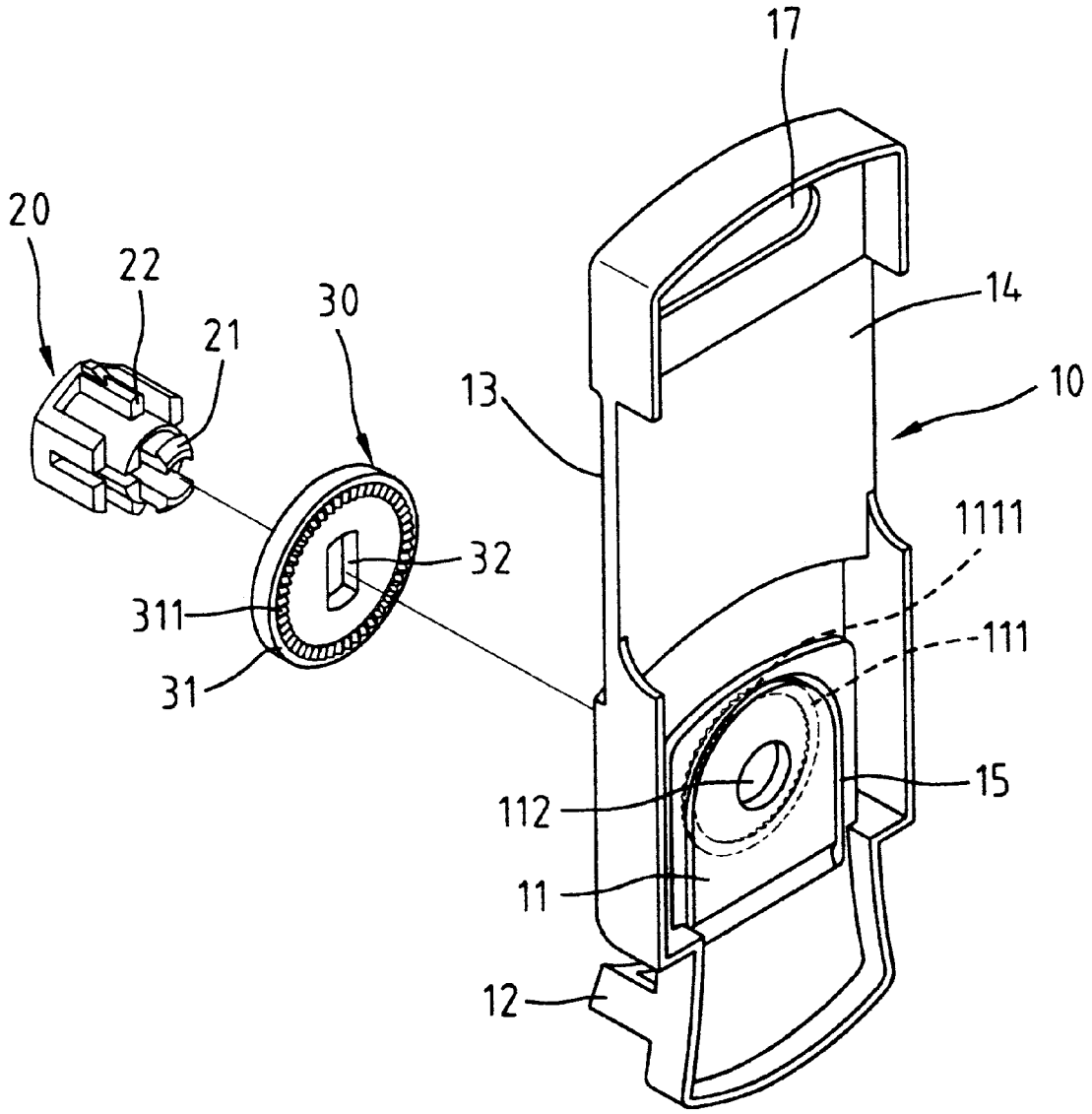
FIG. 8 is an exploded rear perspective view of the second embodiment of the tool pack in accordance with the present invention.
Figure 9:
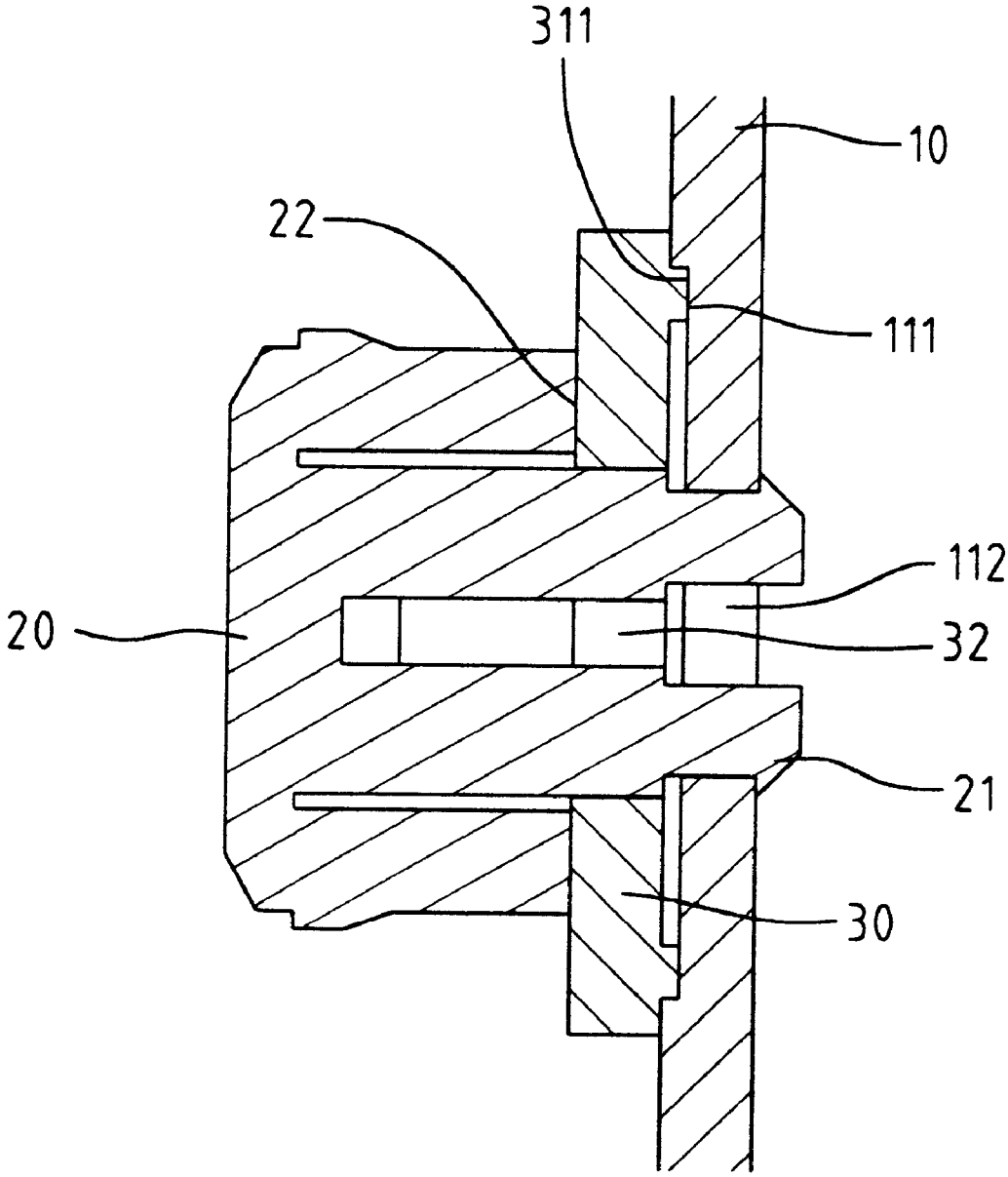
FIG. 9 is an enlarged partial sectional view of the tool pack in FIG. 7.

FIGS. 7 through 9 illustrate a second embodiment of the tool pack in accordance with the present invention that is modified from the first embodiment shown in FIGS. 1 through 3. The only difference between these two embodiments is that in this embodiment the annular toothed portion 111 of the flexible portion 11 is formed on the front side 13 of the board 10 and the sounding plate 30 is attached to the front side 13 of the board 10.

Figure 10:
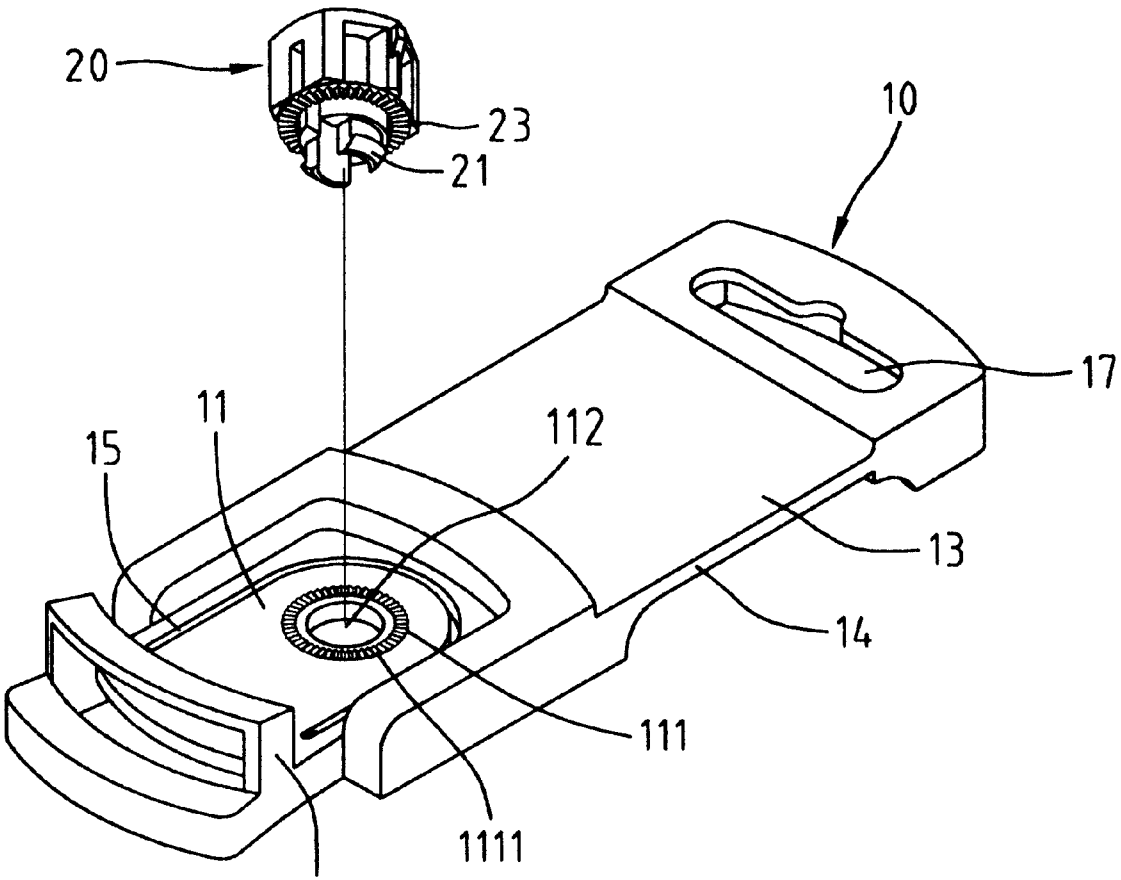
FIG. 10 is a front perspective view of a third embodiment of the tool pack in accordance with the present invention.
Figure 11:
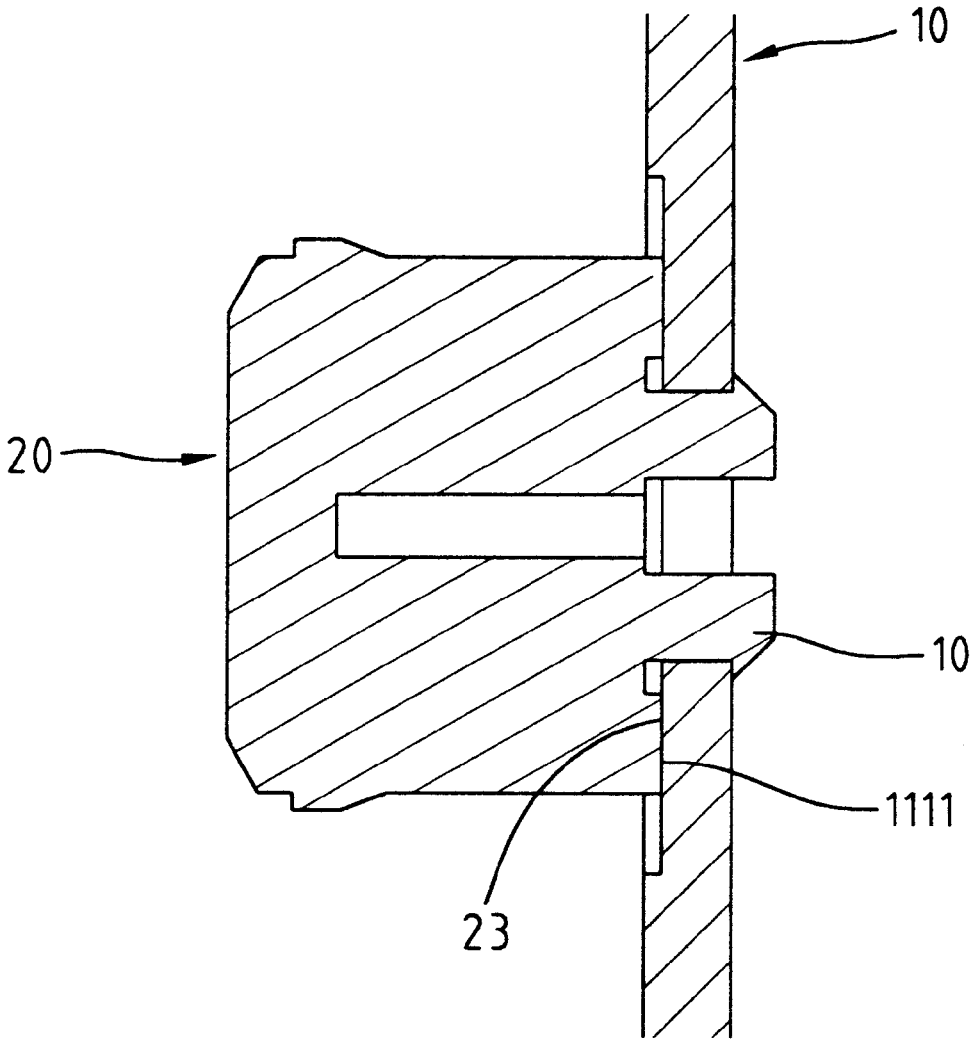
FIG. 11 is an enlarged partial sectional view of the tool pack in FIG. 10.

FIGS. 10 and 11 illustrate a third embodiment of the tool pack in accordance with the present invention that is modified from the second embodiment shown in FIGS. 7 through 9. The only difference between these two embodiments is that in this embodiment the sounding plate 30 is omitted and the rotary member 20 includes an annular toothed portion 23 for meshing with the annular toothed portion 111 of the flexible portion 11 and that the resilient hook 21 of the rotary member 20 engages with the hole 112 of the board 10.

Figure 12:
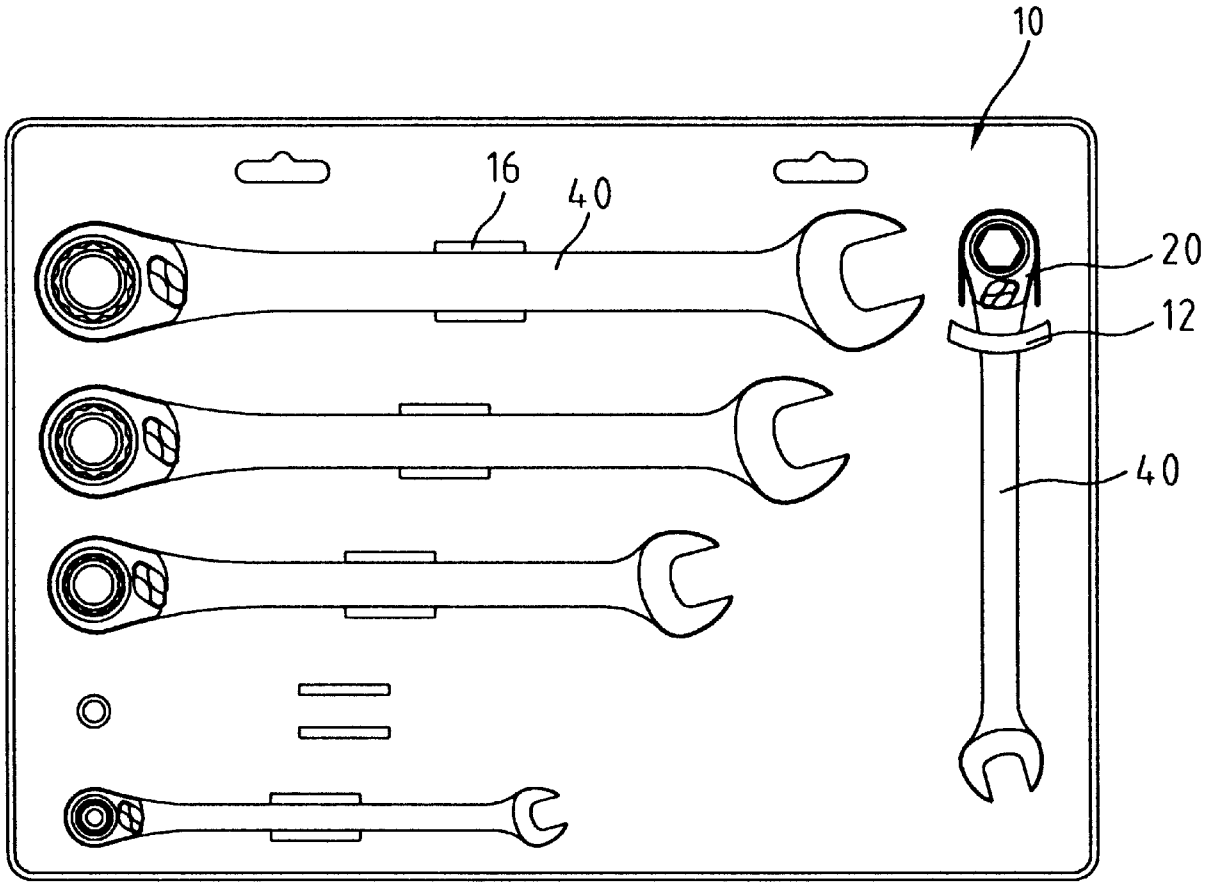
FIG. 12 is a top view of a tool box comprising the try-on device in accordance with the present invention.
Figure 13:
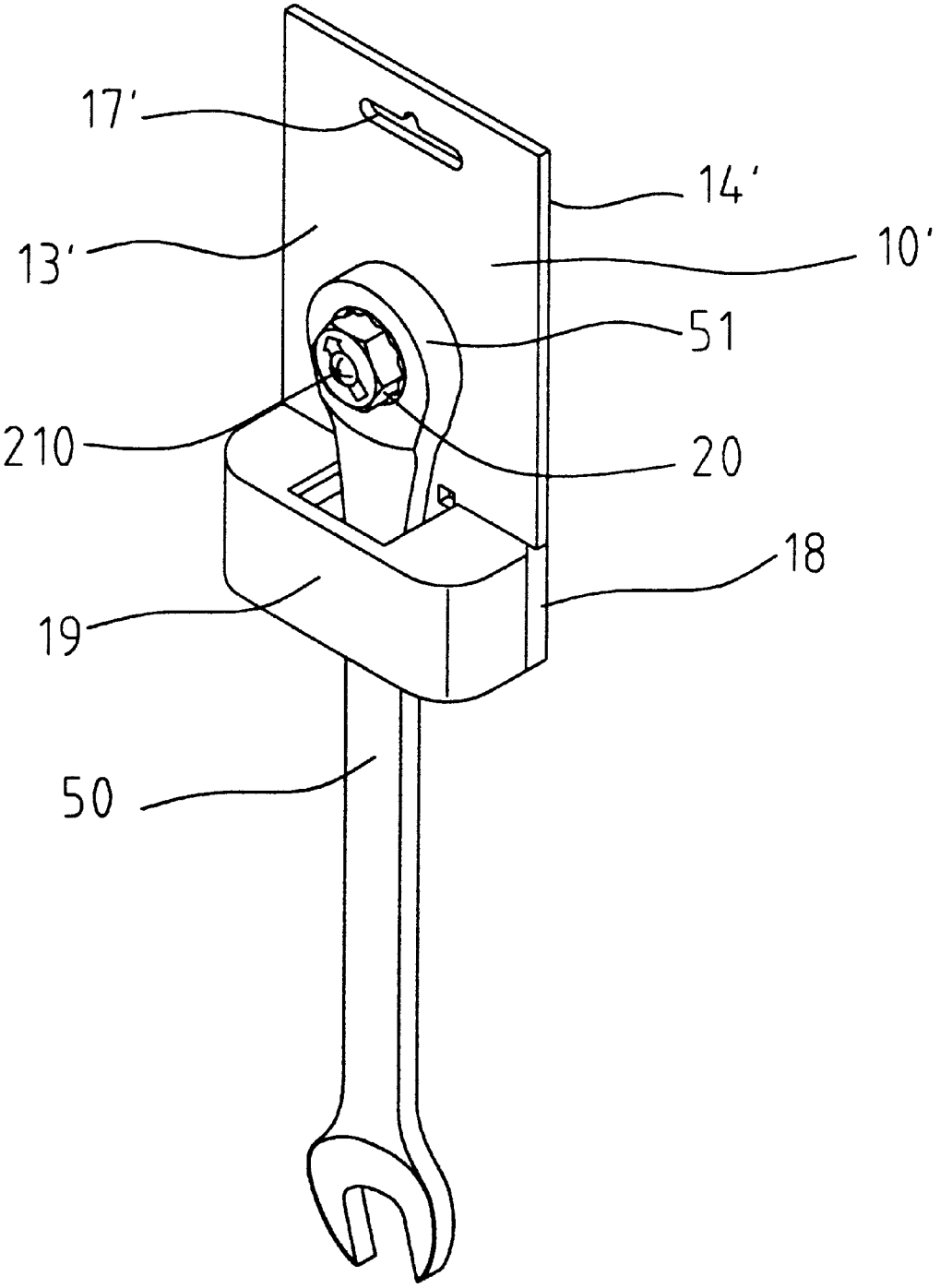
FIG. 13 is a front perspective view of a modified embodiment of the tool pack in accordance with the present invention.
Figure 14:
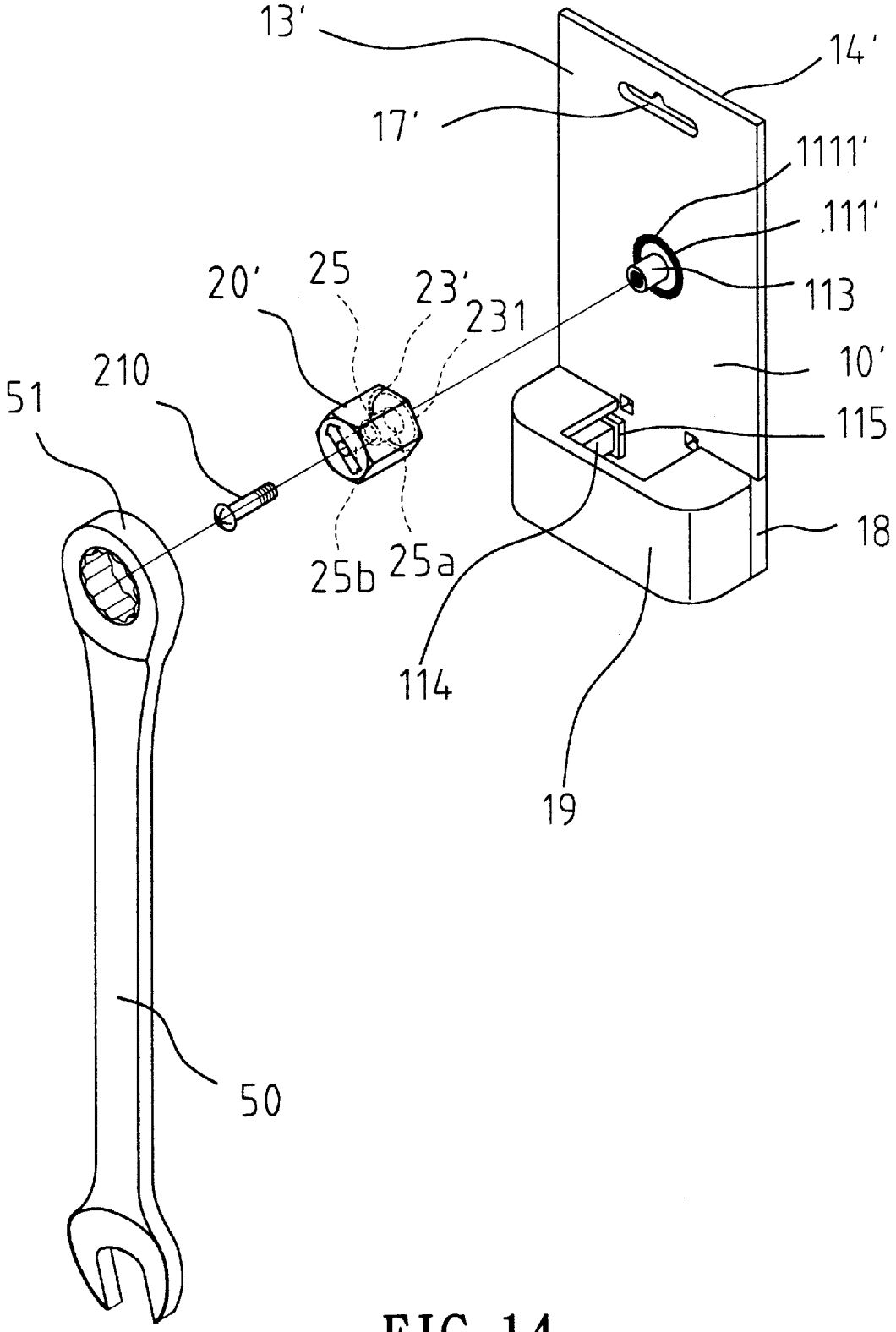
FIG. 14 is a front exploded perspective view of the modified embodiment of the tool pack in FIG. 13.
Figure 15:
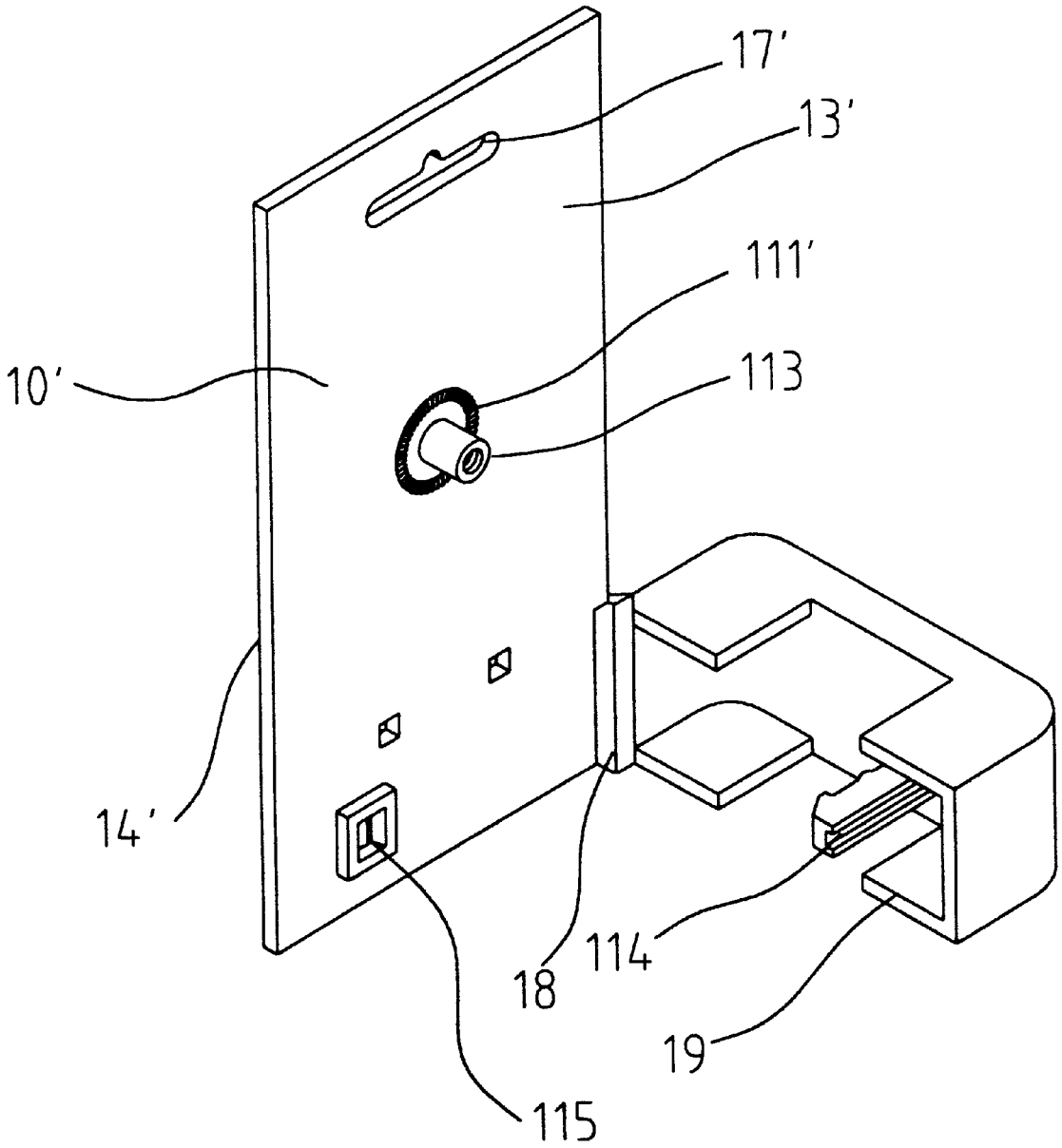
FIG. 15 is a perspective similar to FIG. 14, illustrating pivotal arrangement of a frame of the tool pack.
Figure 16:
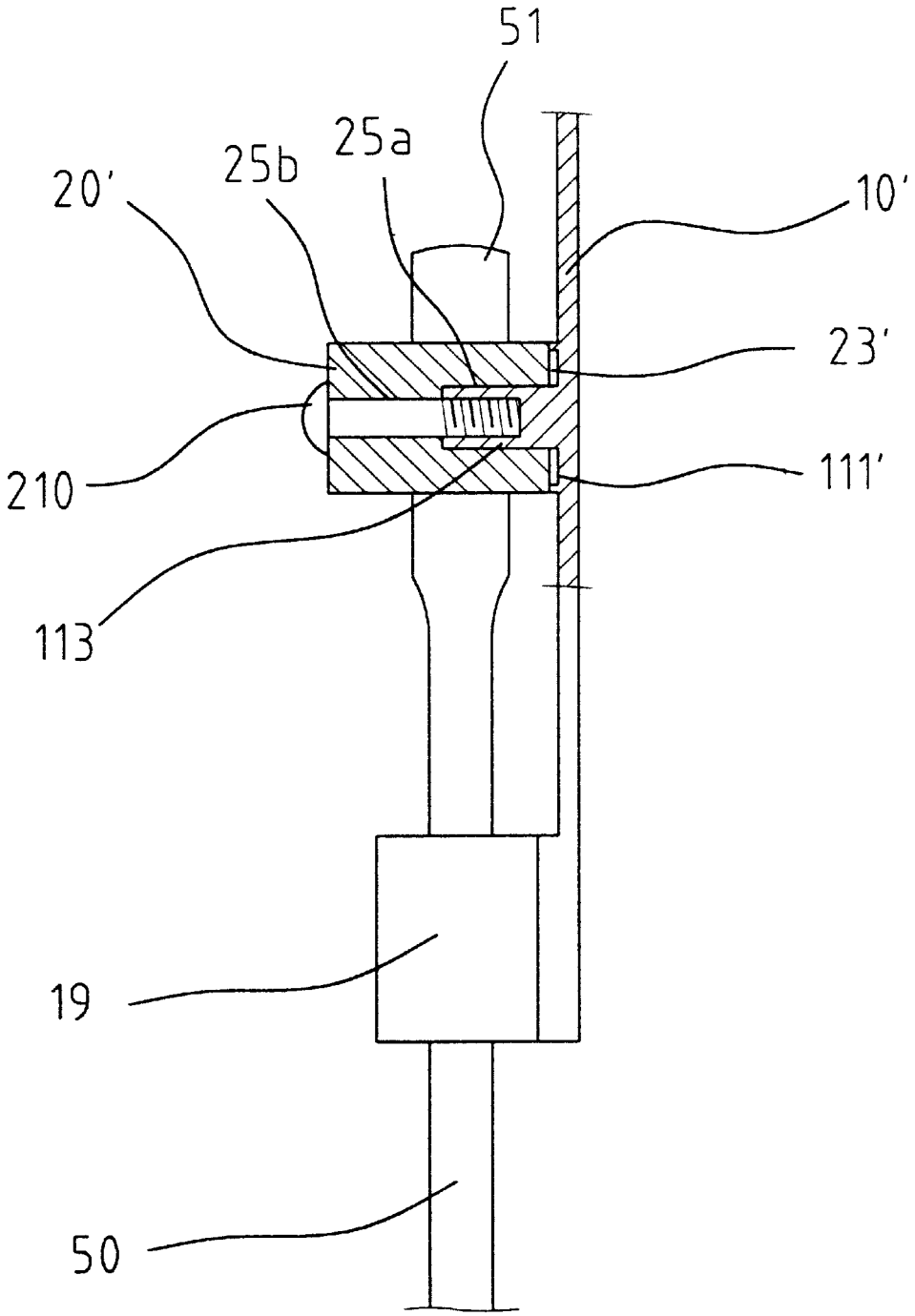
FIG. 16 is an enlarged partial sectional view of the tool pack in FIG. 13.

FIG. 12 is a further modified embodiment of the present invention, wherein the board 10 is enlarged to form a bottom board of a tool holder that comprises a plurality of holding means 16 for holding wrenches 40 of various sizes.

FIGS. 13 through 16 illustrates a further modified embodiment of the tool pack in accordance with the present invention. In this embodiment, the tool pack includes a board 10' having a front side 13' and a rear side 14'. A hanging hole 17' is defined in an upper end of the board 10' and a pivotal portion 18 is formed on a side of a lower end of the board 10'. An engaging hole 115 (FIG. 15) is defined in the other side of the lower end of the board 10'. A frame 19 has an end in pivotal connection with the pivotal portion 18 of the board 10' and a hook 114 formed on the other end thereof for releasably engaging with the engaging hole 115 of the board 10'.

A peg 113 is formed on the front side 13' of the board 10' and an annular toothed portion 111' is defined in the front side 13 and surrounds the peg 113. The annular toothed portion 111' consists of a plurality of planar teeth 1111' (FIG. 4). The peg 113 includes a screw hole (not labeled). Referring to FIG. 4, a substantially hexagonal rotary member 20' includes an annular toothed portion 23' formed on an end face thereof. The annular toothed portion 23' consists of a plurality of planar teeth 231 for meshing with the planar teeth 1111' of the annular toothed portion 111' of the board 10'. A longitudinal through-hole 25 is defined in the rotary member 20' and includes a first section 25*a* for receiving the peg 113 of the board 10' and a second section 25*b* through which a bolt 210 extends.

In assembly, the bolt 210 is extended through the second section 25*b* of the through-hole 25 and engaged with the screw hole of the peg 113 of the board 10' with the peg 113 being received in the first section 25*a* of the through-hole 25 and with the annular toothed portion 23' of the rotary member 20' engaged with the annular toothed portion 111' of the board 10'.

In use, an end 51 of a wrench 50 is engaged with the rotary member 20' and the hook 114 of the frame 19 is engaged with the engaging hole 115 of the board 10'. Thus, the customer may turn the wrench 50 to try it, and rotational movement of the wrench 50 is limited by the frame 19. Again, clicks are generated by the planar teeth 1111' and 231 during rotation of the wrench 50.

Although the invention has been explained in relation to its preferred embodiment, it is to be understood that many other possible modifications and variations can be made without departing from the scope of the invention as hereinafter claimed.

What is claimed is:

1. A tool pack comprising:

a board including a hole, the board further including an annular toothed portion surrounding the hole;

a sounding plate including a positioning hole, the sounding plate further including an annular toothed portion on a side thereof and surrounding the positioning hole; and a rotary member having a first end and a second end, the first end of the rotary member being extended through the positioning hole of the sounding plate and the hole of the board to allow simultaneous rotation of the rotary member and the sounding plate relative to the board with the annular toothed portion of the sounding plate meshing with the annular toothed portion of the board, the second end of the rotary member being adapted to be engaged with an end of a tool to rotate therewith;

wherein the sounding plate is turned when the rotary member is turned, and the annular toothed portion of the sounding plate moves across the annular toothed portion of the board to generate clicks.

2. The tool pack as claimed in claim 1, wherein the board includes a non-rectilinear slot to thereby define a flexible portion including the annular toothed portion of the board, whereby the annular toothed portion of the board is moved slightly away from the annular toothed portion of the sounding plate during rotation of the sounding plate to reduce wear to the annular toothed portion of the board and the annular toothed portion of the sounding plate.

3. The tool pack as claimed in claim 1, wherein the board includes a non-rectilinear slot to thereby define a flexible portion including the annular toothed portion of the board, the flexible portion being capable of reducing a profile of a tool packed by the tool pack by means of bending the flexible portion relative to a remaining portion of the board.

4. The tool pack as claimed in claim 1, wherein the annular toothed portion of the board and the annular toothed portion of the sounding plate consist of a plurality of planar teeth.

5. The tool pack as claimed in claim 1, wherein the annular toothed portion of the board is formed on a front side of the board and the sounding plate is mounted to the front side of the board.

6. The tool pack as claimed in claim 1, wherein the annular toothed portion of the board is formed on a rear side of the board and the sounding plate is mounted to the rear side of the board.

7. The tool pack as claimed in claim 1, wherein the rotary member comprises a resilient hook with a longitudinal slit, the resilient hook being compressed when passing through the hole of the board and the positioning hole of the sounding plate and then returned to its initial position to thereby provide a positioning effect.

8. The tool pack as claimed in claim 1, wherein the board further includes a frame for limiting rotation of the tool.

9. The tool pack as claimed in claim 8, wherein the board includes an engaging hole, and wherein the frame comprises a first end pivotally connected to the board and a second end releasably engaged with the engaging hole of the board.

10. A tool pack comprising:

a board including an annular toothed portion; and a rotary member having a first end and a second end, the first end of the rotary member including an end face with an annular toothed portion, the first end of the rotary member being engaged with the board to allow rotation of the rotary member relative to the board with the annular toothed portion of the rotary member meshing with the annular toothed portion of the board, the second end of the rotary member being adapted to be engaged with an end of a tool to rotate therewith;

wherein when the rotary member is turned, the annular toothed portion of the rotary member moves across the annular toothed portion of the board to generate clicks; and wherein the board includes a non-rectilinear slot to thereby define a flexible portion including the annular toothed portion of the board, whereby the annular toothed portion of the board is moved slightly away from the annular toothed portion of the rotary member during rotation of the sounding plate to reduce wear to the annular toothed portion of the board and the annular toothed portion of the rotary member.

11. The tool pack as claimed in claim 10, wherein the annular toothed portion of the board and the annular toothed portion of the rotary member consist of a plurality of planar teeth.

12. The tool pack as claimed in claim 10, wherein the board includes a hole and the annular toothed portion of the board surrounds the hole, and wherein the first end of the rotary member is rotatably engaged in the hole of the board.

13. The tool pack as claimed in claim 12, wherein the rotary member comprises a resilient hook with a longitudinal slit, the resilient hook being compressed when passing through the hole of the board and then returned to its initial position to thereby providing a positioning effect.

14. The tool pack as claimed in claim 10, wherein the board further comprises at least one holding means for holding tools.

15. A tool pack comprising:

a board including an annular toothed portion; and a rotary member having a first end and a second end, the first end of the rotary member including an end face with an annular toothed portion, the first end of the rotary member being engaged with the board to allow rotation of the rotary member relative to the board with the annular toothed portion of the rotary member meshing with the annular toothed portion of the board, the second end of the rotary member being adapted to be engaged with an end of a tool to rotate therewith;

wherein when the rotary member is turned, the annular toothed portion of the rotary member moves across the annular toothed portion of the board to generate clicks; and wherein the board includes a non-rectilinear slot to thereby define a flexible portion including the annular toothed portion of the board, the flexible portion being capable of reducing a profile of a tool packed by the tool pack.

16. A tool pack comprising:

a board including an annular toothed portion; and a rotary member having a first end and a second end, the first end of the rotary member including an end face with an annular toothed portion, the first end of the rotary member being engaged with the board to allow rotation of the rotary member relative to the board with the annular toothed portion of the rotary member meshing with the annular toothed portion of the board, the second end of the rotary member being adapted to be engaged with an end of a tool to rotate therewith;

wherein when the rotary member is turned, the annular toothed portion of the rotary member moves across the annular toothed portion of the board to generate clicks;

wherein the board further includes a frame for limiting rotation of the tool; and wherein the board includes an engaging hole, and wherein the frame comprises a first end pivotally connected to the board and a second end releasably engaged with the engaging hole of the board.

17. A tool pack comprising:

a board including an annular toothed portion; and a rotary member having a first end and a second end, the first end of the rotary member including an end face with an annular toothed portion, the first end of the rotary member being engaged with the board to allow rotation of the rotary member relative to the board with the annular toothed portion of the rotary member meshing with the annular toothed portion of the board, the second end of the rotary member being adapted to be engaged with an end of a tool to rotate therewith;

wherein when the rotary member is turned, the annular toothed portion of the rotary member moves across the annular toothed portion of the board to generate clicks; and wherein the board includes a peg and the annular toothed portion of the board surrounds the peg, and wherein the first end of the rotary member is rotatably engaged in the peg of the board.

* * * * *